US008171654B2

(12) United States Patent
Rudd, Jr. et al.

(10) Patent No.: US 8,171,654 B2
(45) Date of Patent: May 8, 2012

(54) MODULAR OPEN-TOE FOOTWEAR RETAINING SYSTEM

(75) Inventors: Walter G. Rudd, Jr., Tucson, AZ (US); Thomas Diegel, Salt Lake City, UT (US); Gary C. Moore, Salt Lake City, UT (US)

(73) Assignee: Dream Weaverz Lifewear LLC, Tucson, AZ (US)

( * ) Notice: Subject to any disclaimer, the term of this patent is extended or adjusted under 35 U.S.C. 154(b) by 479 days.

(21) Appl. No.: 12/392,240

(22) Filed: Feb. 25, 2009

(65) Prior Publication Data

US 2010/0212184 A1 Aug. 26, 2010

(51) Int. Cl.
*A43B 3/12* (2006.01)
*A43B 3/24* (2006.01)

(52) U.S. Cl. ..... 36/11.5; 36/101

(58) Field of Classification Search ..... 36/11.5, 36/101, 136

See application file for complete search history.

(56) References Cited

U.S. PATENT DOCUMENTS 4,172,330 A * 10/1979 Kao ..... 36/11.5
5,339,543 A * 8/1994 Lin ..... 36/101
5,921,008 A * 7/1999 Ruff ..... 36/136
6,769,204 B1 8/2004 Phillips
D542,512 S 5/2007 Krutilek et al.
7,540,098 B2 * 6/2009 Bast et al. ..... 36/11.5
2007/0245597 A1 * 10/2007 Krutilek et al. ..... 36/101

OTHER PUBLICATIONS

KlipFlops Sep. 28, 2006 YouTube Video http://www.youtube.com/watch?v=4Ujq-y2cmsA.

* cited by examiner

*Primary Examiner* — Ted Kavanaugh
(74) *Attorney, Agent, or Firm* — Trent H. Baker; Baker & Associates PLLC

(57) ABSTRACT

One embodiment of the present invention relates to an article of open-toe footwear including a sole member and a modular retaining system that allows a user to affect the appearance and function of the article of footwear. The modular retaining system includes a strap member and a plurality of coupling members. The strap member extends from an upper surface of the sole member over a corresponding user's foot between various recesses located on the surface of the sole member. The end regions of the strap member are releasably coupled with the sole member at the recesses via a releasable engagement with coupler members oppositely oriented within the recesses from a lower surface of the sole member. The releasable engagement between the strap member and the coupling members may utilize a threaded coupling configuration in which a male portion of the coupler member is threadably coupled within a corresponding female portion of the end region.

17 Claims, 4 Drawing Sheets

122
124
134
132

122
124
134
160
132
126

122
126
124'
146
134
132

142
144
122
124
134
132
130

MODULAR OPEN-TOE FOOTWEAR RETAINING SYSTEM

FIELD OF THE INVENTION

The invention generally relates to open-toe footwear retaining systems. In particular, the present invention relates to systems and methods for interchangeably retaining an article of open-toe footwear on a user's foot.

BACKGROUND OF THE INVENTION

Numerous forms of footwear provide users with alternative functionality and stylistic design. For example, closed-toe footwear is a term that may describe forms of footwear that substantially cover or enclose the toe region of a corresponding user's foot. The toe region of a user's foot generally refers to the region of the foot located distal to the metatarsal bones. Conventional closed-toe footwear includes sneakers, boots, pumps, etc. Open-toe footwear is a term that may describe forms of footwear which allow a substantial portion of the toe region to remain exposed. Common forms of uncovered, open-toe footwear include sandals, flip flops, thongs, etc. Open-toe footwear utilizes some form of retaining system to maintain engagement with the user's foot during movement. The retaining system extends upward from the article of footwear and around a portion of the user's foot. For example, flip flops or thongs generally include a strap that extends in part over the metatarsal region of the user's foot to minimize impediment to the upper dorsal surface of the user's foot during dorsifflexion.

One of the problems with conventional open-toe footwear is the limited variety in function and aesthetics of a single article of footwear. The retaining system provides one of the most distinguishing aesthetic and functional aspects of most open-toe footwear. Therefore, the functionality and appearance of an article of footwear is in large part defined by the retaining system. For example, a yellow strap composed of a rubber material with a particular durometer will provide a distinct footwear appearance and function for the user. However, if a user wishes to display an alternative appearance or utilize an alternative function, this same article of footwear cannot be easily adapted or interchanged. While from a retail standpoint this encourages users to purchase multiple articles of footwear, it is both inefficient and wasteful. In addition, it limits the value of one article of footwear.

Therefore, there is a need in the industry for a modular retaining system for open-toe footwear that is both intuitive to operate and retains the integrity of the original article of footwear while providing alternative functionality and/or appearance.

SUMMARY OF THE INVENTION

The present invention relates to open-toe footwear retaining systems. One embodiment of the present invention relates to an article of open-toe footwear including a sole member and a modular retaining system that allows a user to affect the appearance and function of the article of footwear. The modular retaining system includes a strap member and a plurality of coupling members. The strap member extends from an upper surface of the sole member over a corresponding user's foot between various recesses located on the surface of the sole member. The location and quantity of holes may be adjusted in alternative embodiments to provide various types of open-toe footwear functionality. The end regions of the strap member are releasably coupled with the sole member at the recesses via a releasable engagement with coupler members oppositely oriented within the recesses from a lower surface of the sole member. The releasable engagement between the strap member and the coupling members may utilize a threaded coupling configuration in which a male portion of the coupler member is threadably coupled within a corresponding female portion of the end region. In addition, the coupling member may include an externally accessible geometric keyed region to enable a user to impart rotational torque upon the coupling member with respect to the sole member and strap member. Depending on orientation, the rotational torque may engage or disengage the corresponding coupling member from one of the end regions of the strap member. A second embodiment of the present invention relates to a method for releasably engaging a retaining system to a sole member, thereby forming an article of open-toe footwear.

Embodiments of the present invention represent a significant advance in the field of open-toe footwear. A modular or interchangeable retaining system enables a user to change the appearance and function of an article of footwear. The modular retaining system of the present invention overcomes numerous design challenges which have prevented prior art systems from market viability. Embodiments of the present invention utilize a coupling scheme that minimizes the potential for breakage at the coupling point between the strap member and the sole member. Likewise, embodiments of the present invention substantially encase the coupling between the strap member and the sole member. This encasement of the coupling scheme thereby maintains proper planarity of the lower surface of the sole member and enables a smooth upper surface upon which a user's foot is disposed.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

Figure 1:
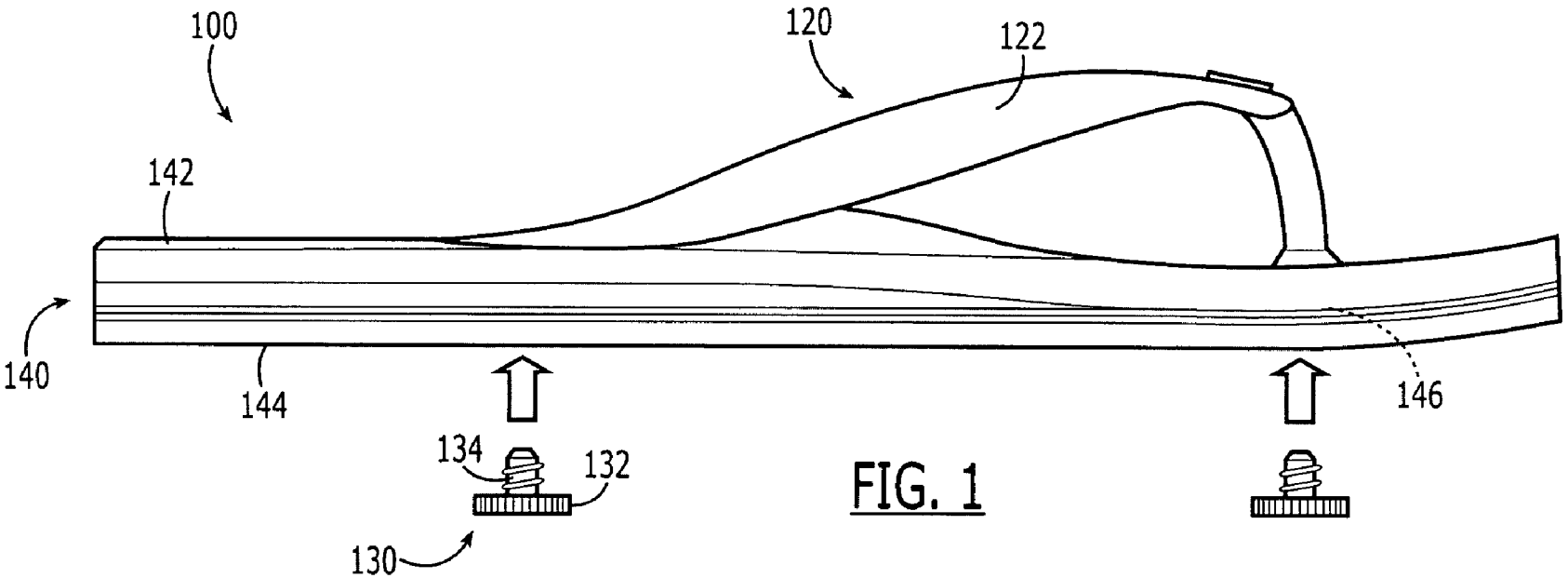
FIG. 1 illustrates a profile view of an open-toe article of footwear in accordance with embodiments of the present invention.
Figures 2A, 2B:
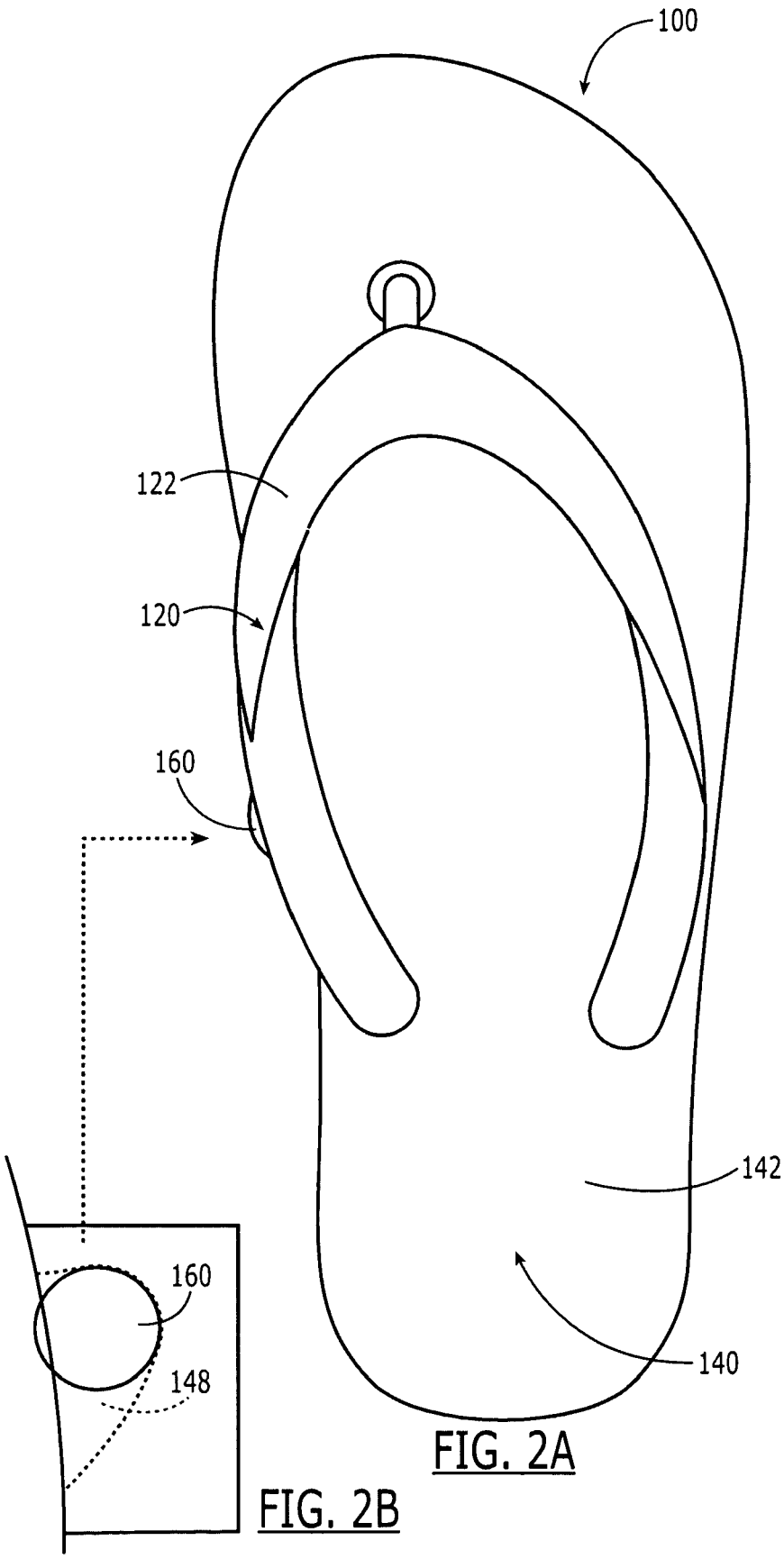
FIG. 2A illustrates an elevated view of the open-toe article of footwear illustrated in FIG. 1.
FIG. 2B illustrates a partial horizontal cutaway view of a medial sleeve positioned within the open-toe article of footwear of FIG. 1, the medial sleeve is illustrated as housing a tool.
Figure 2C:
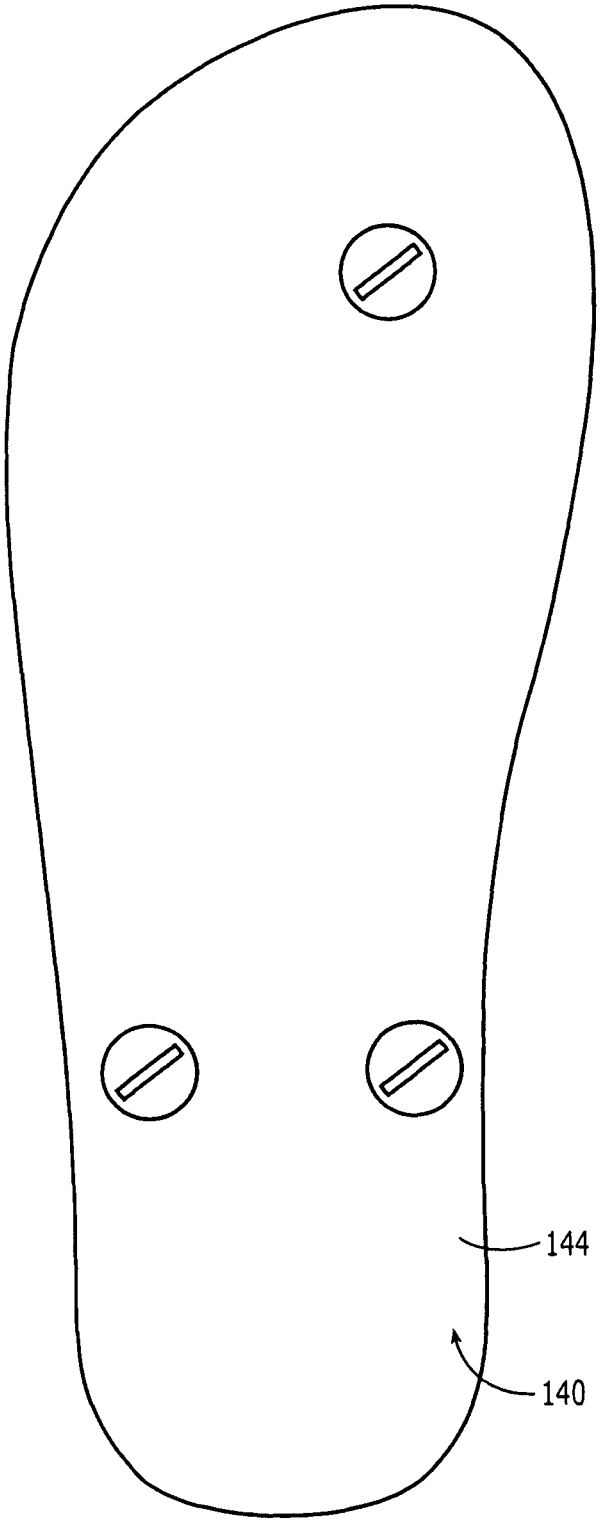
FIG. 2C illustrates a lower view of the open-toe article of footwear illustrated in FIG. 1.

The present invention relates to open-toe footwear retaining systems. One embodiment of the present invention relates to an article of open-toe footwear including a sole member and a modular retaining system that allows a user to affect the appearance and function of the article of footwear. The modular retaining system includes a strap member and a plurality of coupling members. The strap member extends from an upper surface of the sole member over a corresponding user's foot between various recesses located on the surface of the sole member. The location and quantity of holes may be adjusted in alternative embodiments to provide various types of open-toe footwear functionality. The end regions of the strap member are releasably coupled with the sole member at the recesses via a releasable engagement with coupler members oppositely oriented within the recesses from a lower surface of the sole member. The releasable engagement between the strap member and the coupling members may utilize a threaded coupling configuration in which a male portion of the coupler member is threadably coupled within a corresponding female portion of the end region. In addition, the coupling member may include an externally accessible geometric keyed region to enable a user to impart rotational torque upon the coupling member with respect to the sole member and strap member. Depending on orientation, the rotational torque may engage or disengage the corresponding coupling member from one of the end regions of the strap member. A second embodiment of the present invention relates to a method for releasably engaging a retaining system to a sole member thereby forming an article of open-toe footwear. Also, while embodiments are described in reference to an open-toe footwear, it will be appreciated that the teachings of the present invention are applicable to other areas.

The following terms are defined as follows:

Dorsal region—the anatomical upper region of a human foot.

Metatarsal region—the anatomical region of a human foot corresponding to the location of the metatarsal bones between the ankle and the toes.

Distal region—the lengthwise anatomical end region of a human foot corresponding to the toes.

Geometric keyed region—a recess or groove having a particular shape configured to key or mate with a corresponding tool.

Chocking—a form of one-way engagement in which a larger area object is prevented or obstructed from passing through a hole or recess with a smaller area.

Sandwich coupling—a form of coupling between three members in which the outer members create a compression force across the middle member.

Reference is initially made to FIGS. 1 and 2A-C, which illustrates various views of an open-toe article of footwear, designated generally at 100. The footwear 100 comprises a sole member 140 and a retaining system for retaining a user's foot to the sole member 140 during use. The sole member 140 includes an upper surface region 142 and a lower surface region 144 forming a height therebetween. The sole member 140 may be composed of an absorbent rubber material such as ethylene vinyl acetate (EVA). The upper and lower surface regions 142, 144 may include various patterns and contours to provide footwear functionalities including grip, comfort, and support. The sole member 140 further includes a plurality of recesses 146 extending between the upper and lower surface regions 142, 144. In the illustrated embodiment, the sole member 140 includes three circular recesses 146. It will be appreciated that various other quantities and shapes of recesses may be utilized while remaining consistent with the present invention. The first recess is positioned at a location corresponding between a user's medial first and second toe. The second and third recesses are positioned substantially equidistantly from the first recess in a triangular configuration. The second and third recesses are located approximately at a lengthwise location corresponding to the location of a user's ankle. One alternative recess location scheme may include only two recesses positioned at the lengthwise metatarsal region on opposite sides. The sole member 140 may also optionally include a sleeve-type enclosure 148 for releasably housing a tool 160. The illustrated enclosure 148 is positioned on the medial side of the sole member 140 between the upper and lower surface regions 142, 144. The illustrated enclosure is also lengthwise positioned at approximately the instep region of a user's foot and oriented substantially parallel to the upper and lower surface regions 142, 144. The tool 160 is specifically shaped to conform to a geometric keyed region 136 on the coupling members 130 discussed below. The tool 160 may be slidably removed from the enclosure 148 for operation and then slidably replaced without removing the footwear 100 from a user's foot.

The retaining system includes a strap member 120 and a plurality of coupling members 130. The strap member 120 further includes a surface region 122 and a plurality of end regions 124 (not visible). The surface region 122 extends from the sole member 140 over a dorsal region of a user's foot (not shown) to maintain engagement with the user's foot during movement. It will be appreciated that the shape and orientation of the surface region 122 may be altered and remain consistent with embodiments of the present invention. The illustrated embodiment utilizes a triangular type surface region 122 corresponding to the location of the recesses 146. The end regions 124 of the strap member 120 extend into the recesses 146. Please refer to FIGS. 4A-4D for further illustration and description of the end regions 124 and the coupling scheme within the recesses 146.

The coupling members 130 are utilized in releasably coupling the strap member 120 to the sole member 140. The illustrated coupling members 130 include a threaded region 134 and a lower region 132. The top threaded region 132 is shaped to threadably engage with a female threaded region 124 (see FIGS. 4A-4D) within each of the end regions 124 of the strap member 120. The coupling members 130 may be composed of a plastic material. The lower region 134 of the coupling member 130 includes a keyed geometric region 136 that facilitates rotating the coupling member 130 with respect to the sole member 140 and strap member 120 (see FIGS. 3A-3D and 4A-4D). The coupling members 130 are initially engaged with the strap member 120 from below the lower surface region 144 of the sole member 140. In the final engaged state between the coupling member 130 and the strap member 120 (FIG. 4D), the coupling member is substantially encased between the upper and lower surface regions 142, 144 of the sole member.

Figure 3A:
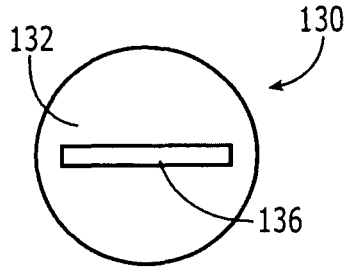
FIG. 3A illustrates an elevated view of the coupling member utilized in the retaining system of the article of footwear illustrated in FIG. 1.
Figure 3B:
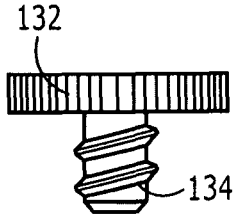
FIG. 3B illustrates a profile view of the coupling member of the retaining system in the article of footwear illustrated in FIG. 1.
Figure 3C:
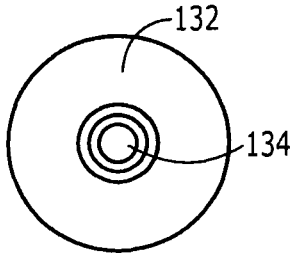
FIG. 3C illustrates a lower view of a coupling member of the retaining system in the article of footwear illustrated in FIG. 1.
Figure 3D:
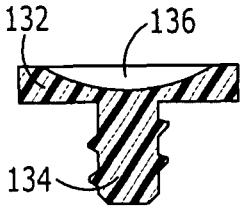
FIG. 3D illustrates a cutaway view of a coupling member of the retaining system in the article of footwear illustrated in FIG. 1.

Reference is next made to FIGS. 3A-3C, which illustrate various detailed views of the coupling member configured to releasably couple the strap member 120 to the sole member 140 in the article of footwear 100 illustrated in FIG. 1. The coupling member includes a threaded region 134, a lower region 132, and a keyed geometric region 136. The elevated view in FIG. 3A illustrates the circular configuration of the lower region 132 and the positioning of the geometric keyed region 136 thereupon. The geometric keyed region forms a slot with lengthwise walls which may be utilized to exert a rotational torque upon the coupling member 130 for purposes of threadable engagement. The profile view of FIG. 3B illustrates the larger diameter of the lower region 132 with respect to the threaded region 134. This discrepancy in diameter is utilized in the releasable coupling scheme between the strap member 120 and the sole member 140. The lower view of FIG. 3C further illustrates the relative shapes of the lower region 132 and the threaded region 134. The cross-sectional profile view of FIG. 3D is taken along a medial line parallel to the geometric keyed region 136. The curved internal profile of the geometric keyed region 136 is utilized so as to substantially match the particular geometric shaped tool 160. In addition, the illustrated curvature of the geometric keyed region 136 is configured to receive and match a United States quarter.

Figures 4A, 4B, 4C, 4D:
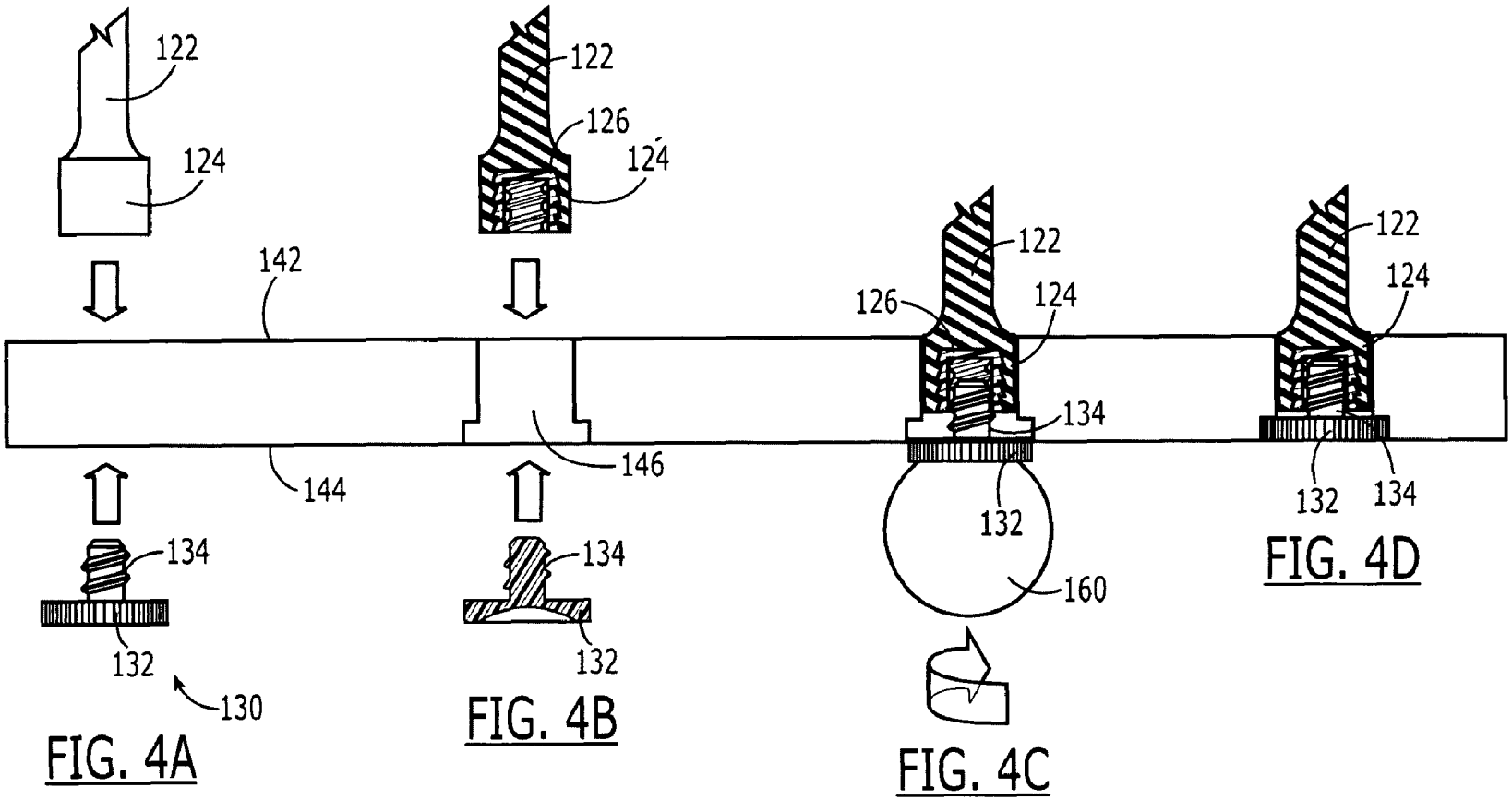
FIG. 4A illustrates a profile operational view of the releasable coupling between the end section of a strap member, the sole member, and a releasable coupler.
FIG. 4B illustrates a cross-sectional cutaway operational view of the releasable coupling between the end section of a strap member, the sole member, and a releasable coupler.
FIG. 4C illustrates a second cross-sectional cutaway operational view of the releasable coupling between the end section of a strap member, the sole member, and a releasable coupler.
FIG. 4D illustrates a third cross-sectional cutaway operational view of the releasable coupling between the end section of a strap member, the sole member, and a releasable coupler.

Reference is next made to FIGS. 4A-4D, which illustrate sequential operational views of the releasable coupling scheme between the end section of a strap member 124, the sole member 140, and a releasable coupler 130. FIGS. 4A and 4B illustrate the initial disengaged orientation of the end region 124 of the strap member, the recess 146 of the sole member 140, and the coupling member 130. The illustrated motion arrows depict the translational direction of the end region 124 and coupling member 130 respectively. FIG. 4B illustrates a cross-sectional view of the corresponding components illustrating the female threaded region 126 within the end region 124 of the strap member 120 and the recess 146 within the sole member 140. The recess 146 is further configured to include a smaller diameter upper portion disposed adjacent to the upper surface region 142 and a larger diameter lower portion disposed adjacent to the lower surface region 144, as illustrated. The smaller diameter upper portion of the recess 146 is sized to accept the end region 124 of the strap member. The larger diameter lower portion of the recess 146 is sized to accept the larger diameter of the lower region 132 of the coupling member 130.

FIG. 3C illustrates an operational engagement of the coupling member 130 with the strap member 120 within the recess 146 utilizing the tool 160. The tool 160 is positioned within the geometric keyed region 136 of the coupling member 130 and rotated in a clockwise orientation to engage the threadable coupling between the coupling member 130 and the strap member 120. In particular, the male threaded region 134 of the coupling member 130 is threaded within the female threaded region 126 of the strap member. FIG. 4D illustrates the final engaged state of coupling between the coupling member 130, sole member 140, and strap member 120. The coupling member is substantially encased within the sole member 140 so as to fit between the upper and lower surface regions 142, 144. The end region 124 of the strap member 120 is also substantially encased within the sole member 140 between the upper and lower surface regions 142, 144. The lower region 132 of the coupling member 130 is positioned within the larger diameter lower portion of the recess so as to be chocked against the smaller diameter upper portion of the recess 146, thereby engaging the strap member 120 to the sole member 140. Likewise, the engagement may be described as a sandwich coupling of the sole member 140 between the end region 124 of the strap member 120 and the lower region 132 of the coupling member 130. The lower portion 132 of the coupling member 132 is also substantially flush and/or parallel to the lower surface region of the sole member 140 in the final engaged state.

Various other embodiments have been contemplated, including combinations in whole or in part of the embodiments described above. Various additional components and or materials may be used in conjunction with embodiments of the present invention.

What is claimed is:

1. An article of open-toe footwear comprising:

a sole member having an upper and lower surface region extending a particular two dimensional length and width substantially corresponding to the plantar surface of a user's foot, wherein the sole member includes a plurality of recesses extending transversely through the sole member between the upper and lower surface regions at independent locations; and a retaining system releasably coupled to the sole member via the plurality of recesses, wherein the retaining system comprises:

a strap member configured to extend from the sole member over the dorsal surface of the user's foot between the plurality of recesses; and a plurality of coupler members configured to releasably engage the strap member to the sole member at each of the corresponding recesses across which the strap member extends, wherein the releasable engagement between the strap member and the plurality of coupler members includes a chocking of the coupler member against the sole member with respect to the strap member; and wherein the strap member further includes end regions which releasably engage with the plurality of coupler members within the plurality of recesses, and wherein the end regions include female threaded regions, and wherein the coupler members include corresponding shaped male threaded regions, and wherein the end regions and a corresponding adjacent portion of the strap member are cylindrically shaped, and wherein a diameter of the end regions is greater than a diameter of the corresponding adjacent portion of the strap member.

2. The system of claim 1, wherein the plurality of recesses includes three recesses, one of which is disposed distal of the metatarsal region and two of which are disposed proximal of the metatarsal region.

3. The system of claim 2, wherein the recesses disposed distal of the metatarsal region is disposed at a location on the sole member which corresponds to be between the user's medial big toe and second toe.

4. The system of claim 1, wherein the strap member extends over the metatarsal dorsal region of the user's foot.

5. The system of claim 1, wherein the coupler members include a keyed female geometric region lengthwise oriented transverse to the lower surface of the sole member and disposed on the coupler member so as to be externally accessible in an engaged state with the strap member.

6. The system of claim 5, wherein the retaining system further includes a tool member shaped to correspond to the keyed female geometric region on the coupler members, wherein the correspondence between the tool member and keyed female geometric region enables rotation of the coupler member with respect to the strap member via rotation of the tool member engaged within the keyed female geometric region, and wherein the tool member is slidably disposed within the sole member parallel to and between the upper and lower surface regions.

7. The system of claim 5, wherein the keyed female geometric region on the coupler members corresponds to the dimensions of a US quarter, wherein the correspondence between a United States quarter and the keyed female geometric region enables rotation of the coupler member with respect to the strap member via rotation of a United States quarter engaged within the keyed female geometric region.

8. The system of claim 1, wherein the coupler members include a lower portion that is configured to be substantially flush with the lower surface of the sole member in an engaged state.

9. The system of claim 8, wherein the plurality of recesses include a smaller diameter upper region disposed adjacent to the upper surface of the sole member and a larger diameter lower region disposed adjacent to the lower surface of the sole member, and wherein the diameter of the lower portion of the coupler members is larger than the diameter of the smaller diameter upper region of the plurality of recesses to facilitate the chocking of the strap member against the sole member in an engaged state.

10. The system of claim 1, wherein the chocking of the coupler member against the sole member includes a sandwich coupling of the coupler member, sole member, and strap member respectively.

11. An article of open-toe footwear comprising:

a sole member having an upper and lower surface region extending a particular two dimensional length and width substantially corresponding to the plantar surface of a user's foot, wherein the sole member includes three recesses extending transversely through the sole member between the upper and lower surface regions at independent locations; and a retaining system releasably coupled to the sole member via the three recesses, wherein the retaining system comprises:

a strap member configured to extend from the sole member over the dorsal surface of the user's foot between the three recesses;

three coupler members configured to releasably engage the strap member to the sole member at each of the corresponding recesses across which the strap member extends, wherein the releasable engagement between the strap member and the coupler members includes a chocking of the coupler member against the sole member with respect to the strap member; and wherein the coupler members include a lower portion that is configured to be substantially flush with the lower surface of the sole member in an engaged state, and wherein the three recesses include a smaller diameter upper region disposed adjacent to the upper surface of the sole member and a larger diameter lower region disposed adjacent to the lower surface of the sole member, and wherein the diameter of the lower portion of the coupler members is larger than the diameter of the smaller diameter upper region of the three recesses to facilitate the chocking of the strap member against the sole member in an engaged state; and wherein the strap member further includes end regions which releasably engage with the plurality of coupler members within the plurality of recesses, and wherein the end regions include female threaded regions, and wherein the coupler members include corresponding shaped male threaded regions, and wherein the end regions and a corresponding adjacent portion of the strap member are cylindrically shaped, and wherein a diameter of the end regions is greater than a diameter of the corresponding adjacent portion of the strap member.

12. A method for releasably engaging a retaining system to a sole member thereby forming an article of open-toe footwear comprising the acts of:

providing a sole member having an upper and lower surface region, wherein the sole member includes a plurality of recesses extending transversely through the sole member between the upper and lower surface regions at independent locations;

positioning a strap member to extend from the upper surface region of the sole member over the dorsal region of a user's foot between the plurality of recesses; and releasably engaging the strap member to the sole member at the plurality of recesses across which the strap member extends; wherein the act of releasably engaging the strap member to the sole member at the plurality of recesses across which the strap member extends further includes threadably coupling a male upper portion of each coupler member to a female portion within each end region of the strap member, and wherein the end regions and a corresponding adjacent portion of the strap member are cylindrically shaped, and wherein a diameter of the end regions is greater than a diameter of the corresponding adjacent portion of the strap member.

13. The method of claim 12, wherein the act of positioning a strap member to extend from the upper surface region of the sole member over the dorsal region of a user's foot between the plurality of recesses further includes extending end regions of the strap member into the plurality of recesses, and wherein the act of engaging the strap member to the sole member at the plurality of recesses across which the strap member extends further includes releasably coupling a coupling member to each of the end regions through the corresponding recess so as to sandwich couple the end regions to the sole member.

14. The method of claim 13, wherein the act of releasably engaging the strap member to the sole member at the plurality of recesses across which the strap member extends further includes threadably coupling a male upper portion of each coupler member to a female portion within each end region of the strap member, wherein the act of threadably coupling a male upper portion of each coupler member to a female portion within each end region of the strap member further includes engaging an independent tool into a geometrically keyed region on a lower surface of the coupler member to effectuate rotational torque upon the coupler member with respect to the sole member and strap member.

15. The method of claim 14, wherein the act of engaging an independent tool into a geometrically keyed region on a lower surface of the coupler member to effectuate rotational torque upon the coupler member with respect to the sole member and strap member further includes slidably removing the independent tool from a cavity between the upper and lower surface region of the sole member.

16. The method of claim 13, wherein the act of releasably engaging the strap member to the sole member at the plurality of recesses across which the strap member extends further includes threadably coupling a male upper portion of each coupler member to a female portion within each end region of the strap member, wherein the act of threadably coupling a male upper portion of each coupler member to a female portion within each end region of the strap member further includes enclosing each coupling member within each recess.

17. The method of claim 13, wherein the act of releasably engaging the strap member to the sole member at the plurality of recesses across which the strap member extends further includes chocking a lower portion of the coupling member against a smaller diameter upper region of the recess such that the lower portion of the coupling member is enclosed within the recess.

* * * * *